US007188825B2

(12) United States Patent
Sennhauser

(10) Patent No.: US 7,188,825 B2
(45) Date of Patent: Mar. 13, 2007

(54) CATCHMENT NET, ESPECIALLY FOR ROCKFALL BLOCKING

(75) Inventor: Marcel Sennhauser, Frasnacht (CH)

(73) Assignee: Fatzer AG, Romanshorn (CH)

( * ) Notice: Subject to any disclaimer, the term of this patent is extended or adjusted under 35 U.S.C. 154(b) by 122 days.

(21) Appl. No.: 10/934,405

(22) Filed: Sep. 7, 2004

(65) Prior Publication Data

US 2005/0050830 A1 Mar. 10, 2005

(30) Foreign Application Priority Data

Sep. 10, 2003 (CH) ..... 1546/03

(51) Int. Cl.
*E01F 7/02* (2006.01)

(52) U.S. Cl. ..... 256/12.5; 256/1; 256/45; 404/15; 405/302.6; 405/302.7

(58) Field of Classification Search ..... 256/12.5, 256/1, 45, 32, 33, 35; 405/258.1, 302.4, 405/302.6, 302.7; 404/15
See application file for complete search history.

(56) References Cited

U.S. PATENT DOCUMENTS 449,185 A * 3/1891 Solomon ..... 405/32
4,610,568 A * 9/1986 Koerner ..... 405/19
4,655,637 A * 4/1987 Vignocchi ..... 405/17
4,710,056 A * 12/1987 Parker ..... 405/15
4,730,810 A * 3/1988 Rambaud ..... 256/12.5
4,819,915 A * 4/1989 Cargnel ..... 256/12.5
5,395,105 A * 3/1995 Thommen, Jr. ..... 256/12.5
5,807,024 A * 9/1998 Benedict ..... 405/32
5,961,099 A * 10/1999 Thommen, Jr. ..... 256/12.5
6,499,911 B2 * 12/2002 Hilliard et al. ..... 405/32
6,592,103 B2 * 7/2003 Sennhauser ..... 256/12.5
6,722,817 B2 * 4/2004 Benedict et al. ..... 405/21
6,929,425 B1 * 8/2005 Kimberlin et al. ..... 405/302.4

* cited by examiner

*Primary Examiner*—Daniel P. Stodola
*Assistant Examiner*—Nahid Amiri
(74) *Attorney, Agent, or Firm*—Wenderoth, Lind & Ponack, L.L.P.

(57) ABSTRACT

A catchment net (1), especially for rockfall blocking, includes a net (2) consisting of elements that engage with each other, and whose two longitudinal sides are each moveably held by a holding rope (3, 4) extending between at least two support bodies (7, 8, 9, 10). The two holding ropes (3, 4) are moveably held by the individual support bodies (7, 8, 9, 10) in their longitudinal direction and tensioned at the side. At least one running rope (37, 38, 39, 40; 47, 48, 49, 50) or suchlike extending alongside the support body on each of the holding ropes (3, 4) preferably within the area of the each support body (7, 8, 9, 10) is affixed with one end on one side and with the other end on the other side to the support body (7, 8, 9, 10). The net (2) is moveably held within the support body area by the running ropes (37, 38, 39, 40; 47, 48, 49, 50). The catchment net (1) therefore guarantees an optimal load distribution as well as a more favorable flow of energy through the net.

22 Claims, 4 Drawing Sheets

CATCHMENT NET, ESPECIALLY FOR ROCKFALL BLOCKING

DESCRIPTION OF RELATED ART

A catchment net of this type is for example known from EP-A-1 205 603. This catchment net incorporates a net consisting of rings that engage with one another, and whose two longitudinal sides are moveably held by an edge, i.e. holding each rope. The edge ropes are affixed to a number of support bodies, which are anchored in slopes, rock walls etc. Between the net and the individual support bodies additional connecting elements are envisaged, whereby the same are preferably equipped with braking means in the form of braking rings for the absorbing of dynamic energy. When a stone or similar object falls into the net, the ring bundles of the net are first moved in rows along the edge ropes just like the rings of a curtain in the direction of the impact, and therefore absorb a part of the dynamic energy. The connecting elements oppose this movement and effect a retaining of the ring rows until the braking rings are extended and the connecting elements subsequently break, whereafter the next connecting elements will be utilised when the ring rows are pulled further. The broken connecting elements can be replaced.

A net of this type has proven itself useful in practical applications, as a large part of the energy created by the impact of rocks can be absorbed without tearing the net, and without dropping the rocks that are to be blocked through the net. During the impact of the rocks the relevant ring net surface between the two support bodies adjacent to the location of the impact will become effective. The impact forces are transferred across this net section to the two support bodies, i.e. their base plates, as well as their support heads which are normally held by retaining ropes.

SUMMARY OF THE INVENTION

It is the purpose of this invention to provide a catchment net of the type described above, the construction and maintenance of which is simple and cost-effective, but which still incorporates an improved effectiveness.

With the catchment net of this invention the two holding ropes are held by the individual support bodies, can be moved in a longitudinal direction, and are tensioned at the side, whereby the net is moveably held within the support body area by running ropes extending along the support bodies and affixed to the holding ropes, so that the ring net surface absorbing the forces can be substantially enlarged in comparison with conventional catchment nets. The catchment net guarantees an optimal load distribution as well as a favourable flow of energy through the net, and therefore reduced forces across the whole of the system. The anchoring forces also are substantially smaller, so that a cost-effective foundation can be realised. In addition the installation and maintenance of the catchment net is very simple.

BRIEF DESCRIPTION OF THE DRAWINGS

The invention will now be described in more detail with reference to the drawings, whereby.

DETAILED DESCRIPTION OF PREFERRED EMBODIMENTS

Figure 1:
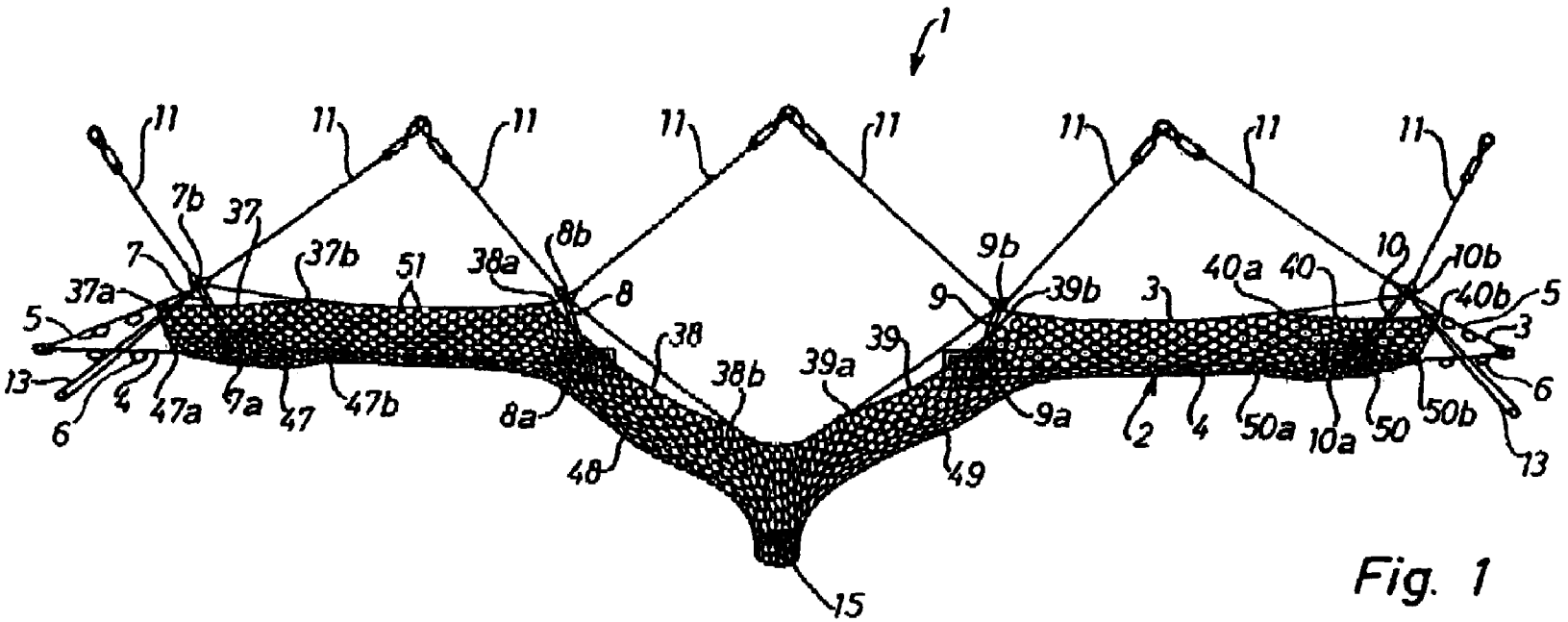
FIG. 1 shows a frontal view of an embodiment of a catchment net of this invention serving as a horizontal gallery following the impact of a rock.

FIG. 1 shows a catchment net 1 constructed as a so-called gallery, which is accordingly aligned almost horizontally, which is for example envisaged on a slope or. a rock wall for the catching of rocks or rubble. The catchment net 1 incorporates a net 2 consisting of elements that engage with one another, preferably rings, whereby the same is held by holding ropes 3,4 allocated to each of the two longitudinal sides, which are in turn affixed to a number of support bodies, for example four support bodies 7, 8, 9, 10. The holding ropes 3, 4 are tensioned at the side, i.e. in their end area, against the slope, i.e. the rock wall. In each one of these end areas of the holding ropes 3,4 at least one braking means 5, 6 is integrated for the absorbing of dynamic forces, whereby two braking means 5, 6 each are envisaged within the two end areas of the holding ropes 3, 4 according to FIG. 1. Such breaking means 5, 6 are known to the expert and are for example described in U.S. Pat. No. 5,207,302. They are therefore not described in detail here. The means preferably consist of braking rings which will effect a defined stretching of the same under the influence of a relevant tension force being applied to the holding ropes 3, 4.

The support bodies 7, 8, 9, 10 are anchored in the slope or rock wall with their base plates 7*a*, 8*a*, 9*a*, 10*a* and project diagonally upwards and away from the same. At their free ends the support bodies 7, 8, 9, 10 are held with their support heads 7*b*, 8*b*, 9*b*, 10*b* via retaining ropes 11 anchored within the slope or the rock wall. Two retaining ropes 11 each extend diagonally to the rear in the direction of the slope or the rock wall from every support head 7*b*, 8*b*, 9*b*, 10*b*. The outer support bodies, i.e. the support bodies 7, 10 allocated to the two narrow sides of the net 2, i.e. their support heads 7*b*, 10*b* are also connected with the slope or the rock wall via unhitching ropes 13.

According to the invention the holding ropes 3, 4 that hold the net 2 are held by the individual support bodies 7, 8, 9, 10 and can be moved in a longitudinal direction, namely either through the support bodies 7, 8, 9, 10, or—and preferably—on the side of the same that faces the slope or the rock wall. For this purpose round or rounded guide elements ensuring a gentle guiding are envisaged for the holding rope 3 on the individual support head 7*b*, 8*b*, 9*b*, 10*b*, and for the base plates 7*a*, 8*a*, 9*a*, 10*a* on the holding rope 4. These are however not visible in FIG. 1, and an embodiment of the same is described below with reference to FIG. 3.

Running ropes 37, 38, 39, 40, i.e. 47, 48, 49, 50 are affixed to both holding ropes 3, 4 within the area of the support bodies 7, 8, 9, 10 in such a way that—when viewed in the longitudinal direction of the net 2—one end 37*a*, 38*a*, 39*a*, 40*a*, and 47*a*, 48*a*, 49*a*, 50*a* of each of the running ropes 37, 38, 39, 40, and 47, 48, 49, 50 is located on one side of the relevant support body 7, 8, 9, 10, and the other end 37*b*, 38*b*, 39*b*, 40*b*, and 47*b*, 48*b*, 49*b*, 50*b* is located on the other side of the relevant support body. The running ropes 37, 38, 39, 40, and 47, 48, 49, 50 here freely pass the support bodies 7,8, 9, 10, namely preferably on the side that faces away from the slope or the rock wall, i.e. on the valley side, although the same can also be positioned on the side that faces the hill in exceptional circumstances.

The net 2 is moveably held directly by the holding ropes 3, 4 on the one hand, namely within the longitudinal area between the running ropes 37*b*, 38*a*; 38*b*, 39*a*; and 39*b*, 40*a* of two running ropes 37, 38, 39, 40, and 47, 48, 49, 50 positioned adjacently in a longitudinal direction. The net 2 is also moveably held by the relevant running ropes 37, 38, 39, 40, and 47, 48, 49, 50 within the support body area on the other hand and guided past the support bodies 7, 8, 9, 10. The moveable arrangement of the net 2 on the holding ropes 3, 4 and on the running ropes 37, 38, 39, 40, and 47, 48, 49, 50, thanks to which the ring bundles of the net 2 can be moved in rows just like a curtain along the relevant ropes preferably occurs via glide elements looped around the edge rings and the relevant rope.

Figure 2:
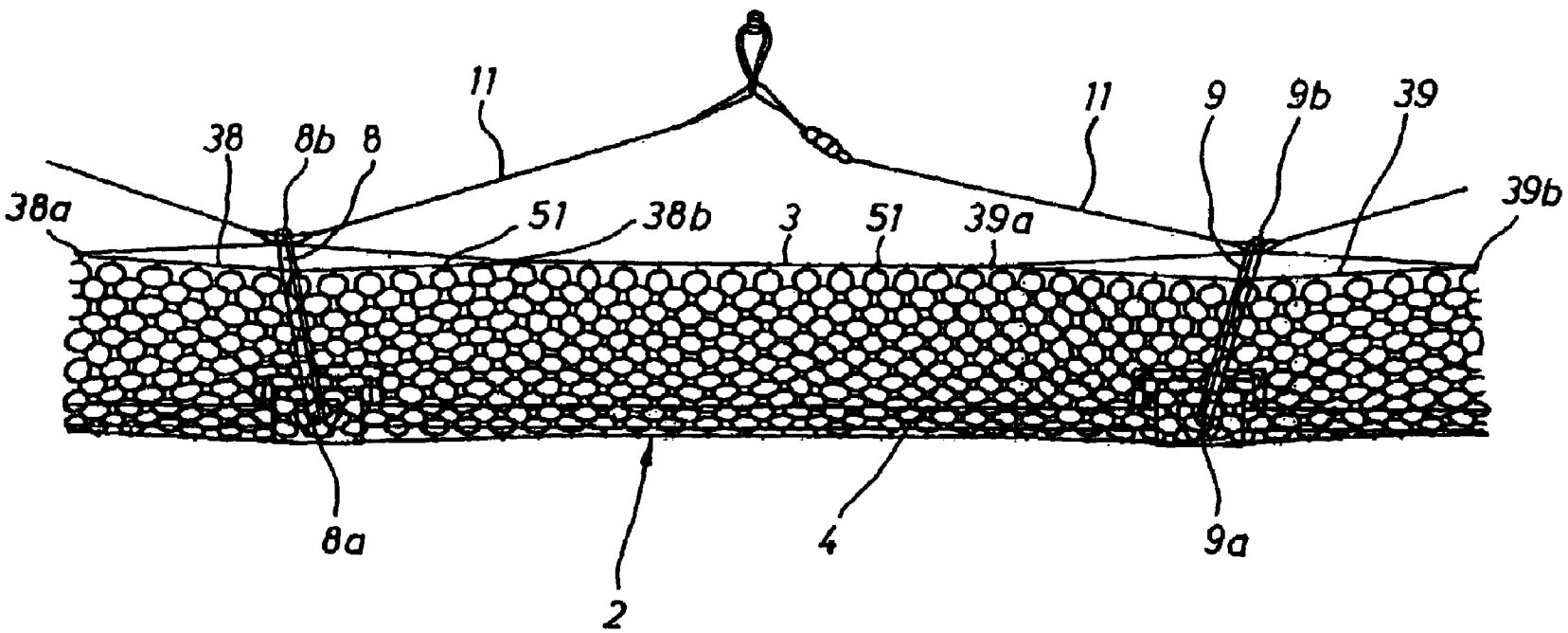
FIG. 2 shows a frontal view of a part of the catchment net illustrated in FIG. 1 prior to the impact of a rock.

The ends of the running ropes 37, 38, 39, 40, and 47, 48, 49, 50 are either fixedly connected to the holding ropes 3, 4 via clip elements not shown in FIGS. 1 and 2, or moveably affixed to the same, whereby the gliding movement of the running rope ends along the holding ropes 3, 4 is preferably initiated when a defined adjustable load is exceeded.

If for example a rock 15 now falls into the area of the net 2 located between the support bodies 8, 9 as illustrated in FIG. 1 the ring bundles of the net 2 are first moved along the holding ropes 3, 4 as well as the running ropes 38, 39, 48, 49 in the direction of the impact location just like a curtain, so that already a part of the dynamic energy is absorbed in this way.

However, the holding ropes 3, 4 moveably held on the support bodies 8, 9, and therefore also the running ropes 38, 39, 48, 49 affixed to the holding ropes 3, 4 are pulled down until the connection points of the running rope ends 38*a*, 39*b* with the holding rope 3 as well as the relevant connection points of the running ropes 48, 49 with the holding rope 4 reach the support bodies 8, 9 and stop any further rope movement when a fixed connection exists between the running ropes 38, 39, and 48, 49 and the relevant holding rope 3, and 4. In this way a possible displacement of the net 2 is limited. During this phase those ring rows that were previously located on the other side of the support bodies 8, 9 and that can now move freely past the support bodies 8, 9 along the running ropes 38, 39, 48, 49 are also used.

The co-operating ring net surface is therefore substantially larger than that of conventional catchment nets with holding ropes fixedly attached to the support bodies. If the running rope ends 38*a*, 38*b*, and 39*a*, 39*b* are for example each located at a distance of 2 m from the support body 8, and 9 prior to the impact as illustrated in FIG. 2, a ring net surface with a length of 14 m will be available during the impact (FIG. 1) when support bodies 8, 9 are positioned at a distance of 10 m from one another, i.e. a 40% larger ring net surface than that of a conventional catchment net with support bodies located 10 m from one another.

The forces that are applied to the holding ropes 3, 4 during the impact into the net 2 effect an activating of the braking means 5, 6 integrated within the side area of the holding ropes 3, 4, which will effect a further energy absorption. The arrangement of the braking means 5, 6 in the side area outside of the protected zone is especially advantageous, as access for replacement purposes is especially easy.

The catchment net according to this invention with the running ropes 37, 38, 39, 40, and 47, 48, 49, 50 affixed to the support bodies 7, 8, 9, 10 on both sides via longitudinally moveable holding ropes 3, 4 guarantees an optimal load distribution with improved distribution onto several support bodies as well as a more favourable flow of forces through the net 2, and therefore smaller forces across the entire system. The anchoring forces are also substantially smaller, which in turn results in shorter anchor lengths and therefore a more cost-effective foundation.

If—as has already been mentioned—the running ropes 37, 38, 39, 40, and 47, 48, 49, 50 are affixed to the holding ropes 3, 4 not firmly, but moveably in such a way that friction or elastic and/or plastic distortion will create a kind of braking effect further energy can be absorbed when a certain load is exceeded during the gliding movement.

Figure 3:
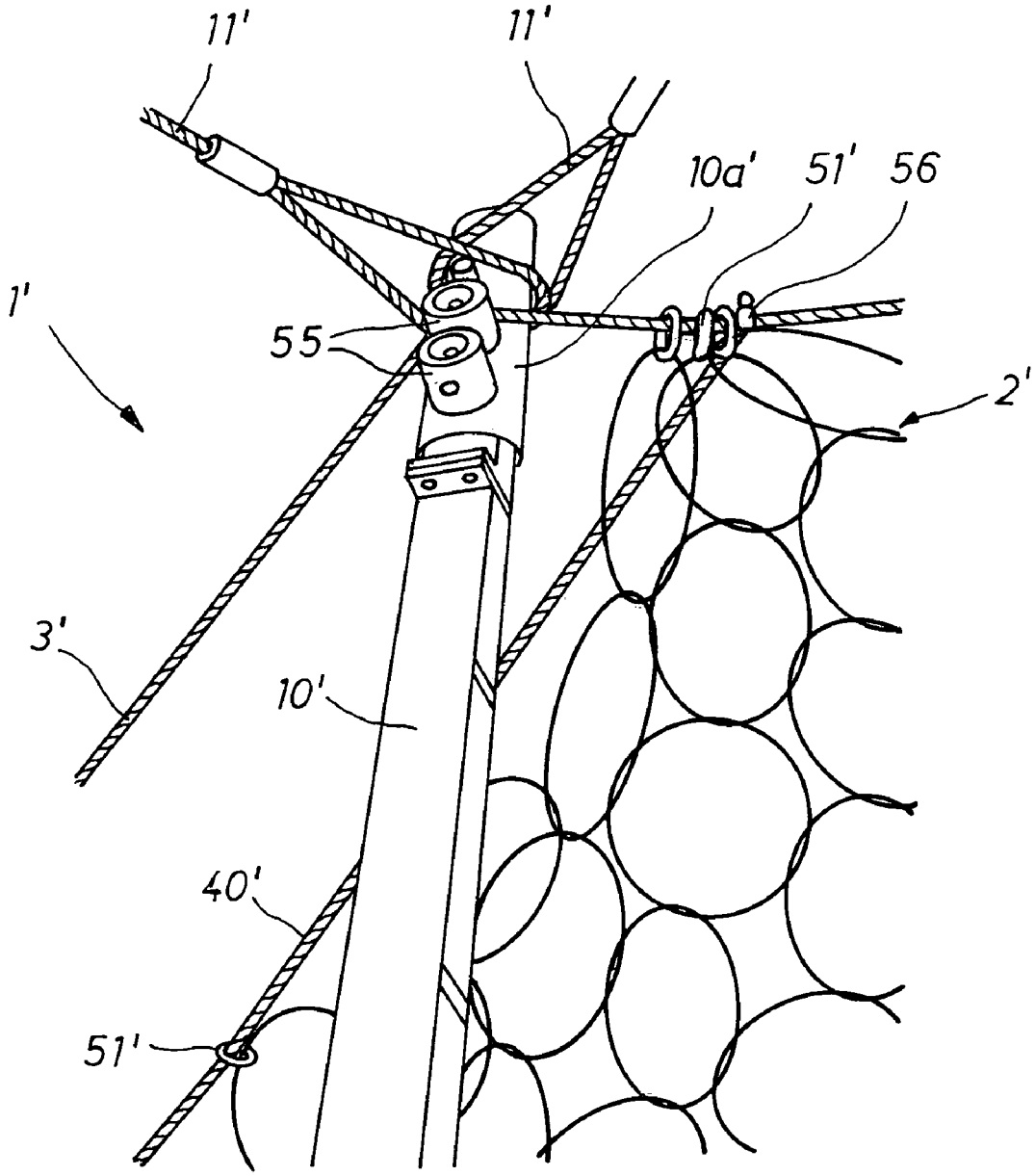
FIG. 3 shows a perspective view of a side section of a vertically aligned catchment net.

In FIG. 3 the outer area of an almost vertically aligned catchment net 1' is illustrated, whereby the same is here positioned on an inclined slope as opposed to FIGS. 1 and 2, and whereby the same catches material rolling down the slope, such as for example rocks. It incorporates an almost vertically aligned outer support body 10' with a support head 10*a*' with a round cross-section, on which the retaining ropes 11' are gently held.

On the side of the support head 10*a*' that faces the slope the guide elements for the upper holding rope 3' that is tensioned at the side already mentioned above are affixed, whereby the same have here been allocated the reference numeral 55, and whereby the same are round for the protection of the moveable holding rope 3'. Similar guide elements are also envisaged at the lower end of the support body 10' near the base plate for the lower holding rope, although these are not illustrated in FIG. 3. A running rope 40' is affixed to the holding rope 3' via clip elements 56, of which only one has been illustrated here, whereby the same extends on the other side of the support body 10' unlike the holding rope 3', so that the net 2' that is moveable via the glide elements 51' along the running rope 40' is located on the valley side before the support body 10'. The net 2' is otherwise directly affixed to the holding rope 3' in the area of the running rope 40' with a number of external elements via the glide elements 51'. In this way a positioning of the net 2' at the upper end near the support body 10' is possible. It is therefore clear that the net can either be fitted with individual glide elements 51' within the area of the holding net 3' which is limited by the two ends of the running rope 40' affixed to the same, or not, as is envisaged for the net shown in FIG. 1.

Figure 4:
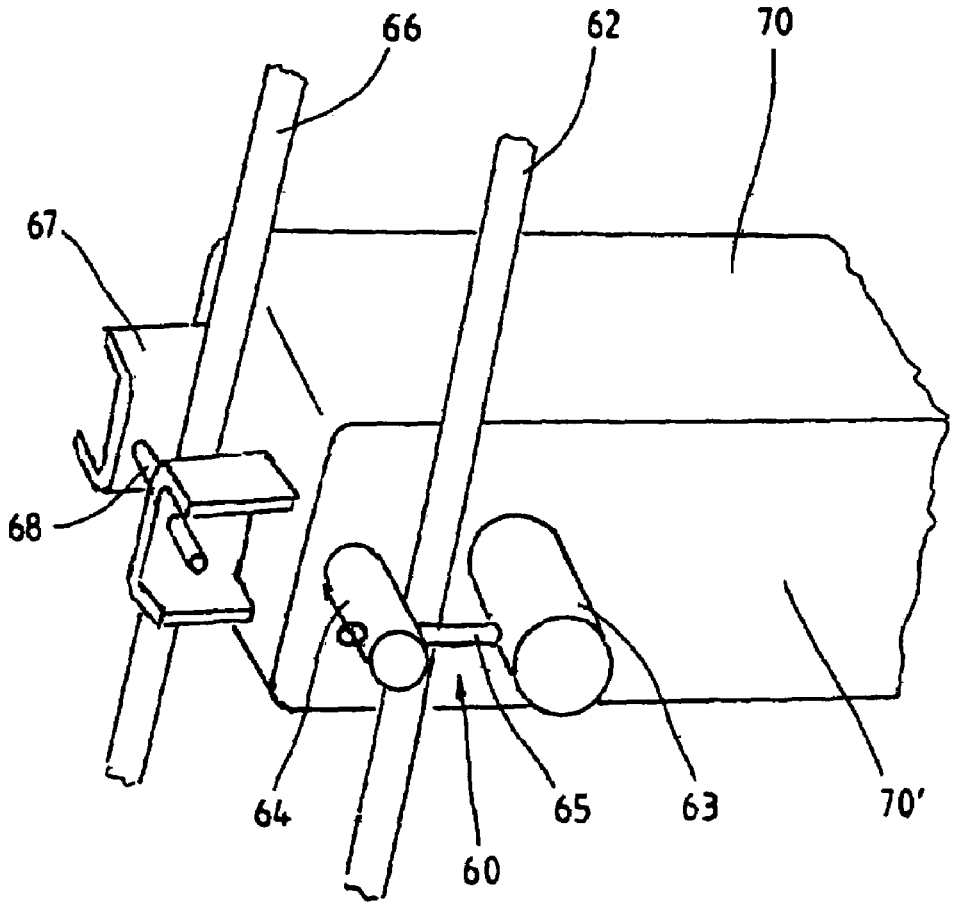
FIG. 4 shows a perspective view of an embodiment of the end of a support body complete with a holding and running rope held by the same.

According to FIG. 4 the running ropes 62 can also be held by guide elements 60 taking the form of pre-defined breaking points in their starting position, which are each affixed to the underside 70' of the support body end 70. The guide elements 60 here consist of two elements 63, 64 affixed to the support body at a distance from one another, as well as by a bolt 65 held by the same and forming the pre-defined breaking point, on which the running rope 62 rests. When a certain pre-defined breaking load is reached this bolt 65 will break, and the running rope 62 will be lowered in the direction of the support bodies in a way that is illustrated in FIG. 1. Also illustrated is the holding rope 66 held on the facing side of the support body 70 with fitting elements 67, 68.

The ring rows of the net gliding along the running rope, which are not illustrated in FIG. 4, can move freely past the relevant support body 8, 9 only when this bolt 65 has been destroyed. As long as the bolt 65 has not been destroyed by the running rope 62 through bending the rings will be held back by this bolt 65.

It is of course also possible to equip the catchment net 1 according to FIGS. 2 and 3 as well as the catchment net 1' of FIG. 3 with additional connecting elements connecting the ring net and/or the running ropes with the support bodies and with braking elements such as those known from EP-A-1 205 603 systems for the higher energy range.

However, for systems for the lower energy range the braking rings envisaged for the side area of the holding ropes of the catchment net of this invention will suffice, namely just eight braking rings per approx. 40 to 50 m of blocking path.

The invention is sufficiently described with the aid of the above embodiments. It could however also be constructed differently. Instead of the running rope it is possible in principle to use rods or bands. The term running ropes can therefore also refer to such embodiments. It is also possible to provide several running ropes in one position.

Alternatively the net, the running rope, and the holding rope could be located on the side of the hill. It must however then be ensured that the net and the ropes can be displaced in the direction of the support bodies. It is of course also possible to use only one retaining rope 11 per support body.

In principle it is for example possible that the net shown in FIG. 1 incorporates running ropes only for the inner support bodies 8, 9, and not for the outer support bodies 7, 10. In particular the running ropes could also be equipped with braking rings or braking means.

The invention claimed is:

1. A catchment net for rockfall blocking, comprising:

a net having two opposed longitudinal sides, and having elements that engage with each other;

a plurality of support bodies;

first and second holding ropes extending along the longitudinal sides of said net, respectively, and being movably held by each of said support bodies so as to be movable in the longitudinal direction, wherein each of said longitudinal sides of said net is movably held by the respective one of said first and second holding ropes; and a plurality of running ropes, at least one of said running ropes having both ends connected to said first holding rope so as to extend across a respective one of said support bodies, and at least one of said running ropes having both ends connected to said second holding rope so as to extend across a respective one of said support bodies, wherein said net is movably held by each of said running ropes so as to be movable along a length of each of said running ropes which extends across said respective one of said support bodies.

2. The catchment net according to claim 1, wherein said support bodies are anchored to a sloped surface such that they extend outwardly from the sloped surface, said first and second holding ropes are positioned at a side of said support bodies that faces the sloped surface, and said running ropes are positioned at a side of said support bodies that faces away from the sloped surface.

3. The catchment net according to claim 2, wherein end portions of said first and second holding ropes are secured to the sloped surface, and wherein the ends of each of said running ropes are fixedly attached to said respective one of said first and second holding ropes by clip elements.

4. The catchment net according to claim 2, wherein the ends of each of said running ropes are movably attached to said respective one of said first and second holding ropes by clip elements arranged so as to move along said respective one of said first and second holding ropes while effecting a braking movement when a defined load is exceeded.

5. The catchment net according to claim 2, further comprising:

at least one braking unit provided on each end portion of said first and second holding ropes.

6. The catchment net according to claim 2, wherein each of said support bodies includes guide elements for movably holding said first and second holding ropes.

7. The catchment net according to claim 2, further comprising:

connecting elements for connecting said net to each of said support bodies, each of said connecting elements having at least one braking unit.

8. The catchment net according to claim 1, wherein the ends of each of said running ropes are fixedly attached to said respective one of said first and second holding ropes by clip elements.

9. The catchment net according to claim 8, wherein end portions of said first and second holding ropes are secured to a sloped surface, and wherein each end portion of said first and second holding ropes is provided with at least one braking unit.

10. The catchment net according to claim 8, wherein each of said support bodies includes guide elements for movably holding said first and second holding ropes.

11. The catchment net according to claim 8, further comprising:

connecting elements for connecting said net to each of said support bodies, each of said connecting elements having at least one braking unit.

12. The catchment net according to claim 1, wherein the ends of each of said running ropes are movably attached to said respective one of said first and second holding ropes by clip elements arranged so as to move along said respective one of said first and second holding ropes while effecting a braking movement when a defined load is exceeded.

13. The catchment net according to claim 12, wherein end portions of said first and second holding ropes are secured to a sloped surface, and wherein each end portion of said first and second holding ropes is provided with at least one braking unit.

14. The catchment net according to claim 12, wherein each of said support bodies includes guide elements for movably holding said first and second holding ropes.

15. The catchment net according to claim 12, further comprising:

connecting elements for connecting said net to each of said support bodies, each of said connecting elements having at least one braking unit.

16. The catchment net according to claim 1, wherein end portions of said first and second holding ropes are secured to a sloped surface, and wherein each end portion of said first and second holding ropes is provided with at least one braking unit.

17. The catchment net according to claim 16, wherein each of said support bodies includes guide elements for movably holding said first and second holding ropes.

18. The catchment net according to claim 16, further comprising:

connecting elements for connecting said net to each of said support bodies, each of said connecting elements having at least one braking unit.

19. The catchment net according to claim 1, wherein each of said support bodies includes guide elements for movably holding said first and second holding ropes.

20. The catchment net according to claim 19, further comprising:

connecting elements for connecting said net to each of said support bodies, each of said connecting elements having at least one braking unit.

21. The catchment net according to claim 1, further comprising:

connecting elements for connecting said net to each of said support bodies, each of said connecting elements having at least one braking unit.

22. The catchment net according to claim 1, wherein said running ropes are each held by guide elements affixed to said support bodies and include pre-defined breaking points, whereby said pre-defined breaking points are destroyed upon receiving a pre-defined breaking load to thereby detach said running ropes from said support body.

* * * * *